US008794221B2

(12) United States Patent
Kobayashi et al.

(10) Patent No.: US 8,794,221 B2
(45) Date of Patent: Aug. 5, 2014

(54) OIL SEPARATOR OF INTERNAL COMBUSTION ENGINE

(75) Inventors: Akihiro Kobayashi, Niiza (JP); Masanori Suto, Kawagoe (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 269 days.

(21) Appl. No.: 13/336,338

(22) Filed: Dec. 23, 2011

(65) Prior Publication Data

US 2012/0312272 A1 Dec. 13, 2012

(30) Foreign Application Priority Data

Jun. 8, 2011 (JP) ..... 2011-128565

(51) Int. Cl.
*F01M 13/04* (2006.01)

(52) U.S. Cl.
USPC ..... 123/572

(58) Field of Classification Search
USPC ..... 123/572–574, 41.86
See application file for complete search history.

(56) References Cited

U.S. PATENT DOCUMENTS 4,627,406 A * 12/1986 Namiki et al. ..... 123/573
5,005,553 A * 4/1991 Washizu et al. ..... 123/572
7,117,858 B2 10/2006 Nonaka et al.
2005/0092267 A1 5/2005 Nonaka et al.
2005/0092268 A1 5/2005 Girard
2007/0215128 A1* 9/2007 Yonebayashi et al. ..... 123/572

FOREIGN PATENT DOCUMENTS

DE 10 2010 042 883 A1 5/2011
EP 1 528 244 A1 5/2005
JP 2000-45749 A 2/2000
JP 2005-120855 A 5/2005
JP 2009-13942 A 1/2009
JP 2009-121281 A 6/2009

* cited by examiner

*Primary Examiner* — M. McMahon
(74) *Attorney, Agent, or Firm* — Foley & Lardner LLP

(57) ABSTRACT

In an oil separator provided in a cylinder head cover of an internal combustion engine and equipped with a partition wall disposed between a blow-by gas inlet and a blow-by gas outlet and having through holes each serving as an orifice for increasing a flow velocity of blow-by gas flow, a collision plate is arranged adjacent to the partition wall so as to be opposed to each of the through holes, for separating oil mist from blow-by gases. At least one upstanding wall is disposed downstream of the collision plate in a manner so as to be adjacent to an opening defined between a lower end of the collision plate and the bottom face of a separator chamber, for recapturing oil mist, once-separated from the blow-by gases but rescattering along with the blow-by gas flow passing through the opening of the collision plate.

6 Claims, 3 Drawing Sheets

OIL SEPARATOR OF INTERNAL COMBUSTION ENGINE

TECHNICAL FIELD

The present invention relates to the improvement of an oil separator provided in a cylinder head cover of an internal combustion engine to separate oil mist in blow-by gases to be discharged out of the engine through the cylinder head cover.

BACKGROUND ART

As is generally known, in an internal combustion engine of an automotive vehicle, blow-by gases (blow-by fumes) containing unburnt gases (some air-fuel mixture), which leak down from combustion chambers into a crankcase past piston rings, are again introduced or recirculated into the combustion chambers through an intake system of the engine, together with fresh air taken in from the outside of the engine, and then combusted. The blow-by gases flowing through the crankcase contain oil mist of lubricating oil. To prevent oil mist from being carried to the intake system, an oil separator is often disposed in the cylinder head cover, so that the blow-by gases can be cleared from the crankcase after oil mist has been separated from the blow-by gases by means of the oil separator. Such oil separators have been disclosed in Japanese Patent Provisional Publication Nos. 2005-120855 (hereinafter is referred to as "JP2005-120855") and 2009-121281 (hereinafter is referred to as "JP2009-121281").

Two blow-by gas passages are generally connected to the cylinder head cover, such that fresh air is introduced through one of the two blow-by gas passages under a normal engine operating condition, and that blow-by gases flow through both the two blow-by gas passages under a high engine load operating condition. Hence, the cylinder head cover is equipped with two oil separators, which are used for the respective blow-by gas passages.

The oil separator as disclosed in each of JP2005-120855 and JP2009-121281 is a so-called inertial oil-mist collision type oil separator in which a partition wall having a plurality of small holes (pores or small openings or fine fluid passages) is disposed in an oil-separator chamber and also a collision plate is disposed adjacent to the partition wall in a manner so as to be opposed to the small holes of the partition wall. When blow-by gases containing oil mist pass through the small holes, the blow-by gas flow velocity increases. Thus, owing to collision of the high-velocity blow-by gas flow with the collision plate, oil mist can be recovered in the form of oil droplets adhered to the collision plate. A slit-shaped opening is also formed at the lower end of the collision plate, to enable oil droplets, adhered to the collision plate and thus separated from the blow-by gases and then gradually growing to greater particle diameters, flowing down along the wall surface of the collision plate, to flow along the bottom face of the oil-separator chamber through the slit-shaped opening toward the downstream side. In this manner, the oil can be dropped and recovered into an engine-valve operating chamber via a drain port of an oil drain pipe formed in the bottom face of the oil-separator chamber.

SUMMARY OF THE INVENTION

In the case of the inertial oil-mist collision type oil separator as disclosed previously, oil droplets, adhered to the collision plate and thus separated from the blow-by gases and then gradually growing to greater particle diameters, flowing down along the collision plate, drop onto the bottom face of the oil-separator chamber while crossing the slit-shaped opening. At the same time, the high-velocity blow-by gas flow, from which oil mist has been removed, passes through the slit-shaped opening. For the reasons discussed above, when the oil droplets fall from the lower end of the collision plate onto the bottom face of the oil-separator chamber while crossing the slit-shaped opening, part of the oil droplets, once-separated from the blow-by gases, tends to be undesirably mixed again with the high-velocity blow-by gas flow passing through the slit-shaped opening such that some oil droplets, mixed again with the high-velocity blow-by gas flow, scatter again (rescatter) along with the high-velocity blow-by gas flow passing through the slit-shaped opening. As a result of this, there is an increased tendency for part of the oil droplets to be carried together with the outgoing blow-by gas flow from a blow-by gas discharge port to the exterior (i.e., the intake system).

It is, therefore, in view of the previously-described disadvantages of the prior art, an object of the invention to provide an oil separator of an internal combustion engine, which is configured to more certainly enhance an oil mist capture performance, while suppressing oil mist, once-separated from blow-by gases in the form of oil droplets having greater particle diameters owing to collision-contact with a collision plate, from rescattering along with blow-by gas flow passing through an opening of the lower end of the collision plate to the exterior (the intake system).

In order to accomplish the aforementioned and other objects of the present invention, an oil separator provided in a cylinder head cover of an internal combustion engine for separating oil mist from blow-by gases to be discharged out of the engine through the cylinder head cover, comprises a separator chamber having a blow-by gas inlet formed at one end and a blow-by gas outlet formed at the other end, a partition wall configured to partition the separator chamber into a separator inlet chamber communicating with the blow-by gas inlet and a separator outlet chamber communicating with the blow-by gas outlet, the partition wall having a plurality of through holes, a collision plate disposed in the separator outlet chamber and arranged adjacent to the partition wall so as to be opposed to each of the through holes, an opening defined between a lower end of the collision plate and a bottom face of the separator chamber, an oil drain arranged in the bottom face of the separator chamber for draining oil, separated from the blow-by gases, from the bottom face of the separator chamber into a valve operating chamber of the engine, at least one upstanding wall disposed downstream of the collision plate in a manner so as to be adjacent to the opening, and vertically protruding from the bottom face of the separator chamber and arranged parallel to the collision plate, and at least one cutout defined between a lower end of the upstanding wall and the bottom face of the separator chamber for allowing oil flow along the bottom face of the separator chamber.

The other objects and features of this invention will become understood from the following description with reference to the accompanying drawings.

DESCRIPTION OF THE PREFERRED EMBODIMENTS

Figure 1:
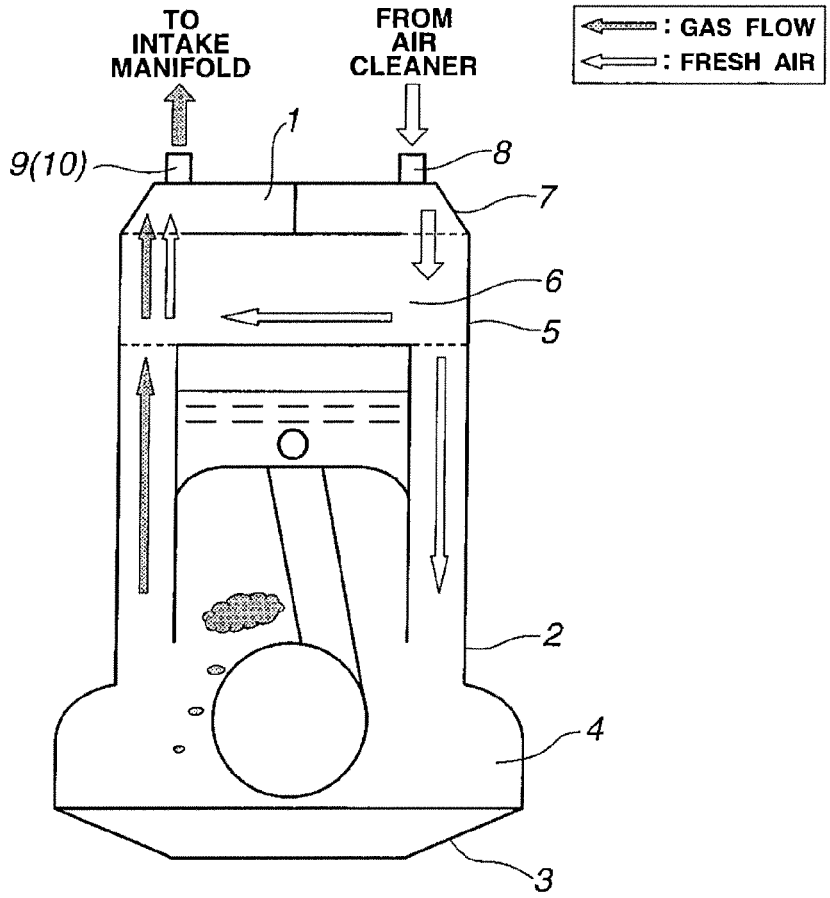
FIG. 1 is a schematic cross-sectional view showing an internal combustion engine equipped with an embodiment of an oil separator according to the present invention.

Referring now to the drawings, particularly to FIG. 1, there is shown the construction of an internal combustion engine employing an oil separator 1 of the embodiment. A crankcase 4 is defined by a cylinder block 2 and an oil pan 3. Crankcase 4 communicates a valve operating chamber 6 defined in a cylinder head 5. A cylinder head cover 7, made of a synthetic resin and constructing part of a crankcase emission control system (a positive crankcase ventilating system or a closed crankcase ventilating system), is provided with (i) a fresh-air inlet 8 connected to a throttle-valve upstream side (e.g., an air cleaner) of an internal-combustion-engine intake system (not shown) and (ii) a crankcase blow-by gas discharge port 9 connected to a throttle-valve downstream side (e.g., an intake manifold). A well-known positive crankcase ventilating (PCV) valve 10 is installed in the blow-by gas discharge port 9, for controlling a blow-by gas flow rate depending on a pressure difference between a pressure in the crankcase and a pressure in the intake manifold. For instance, during idling, PCV valve 10 allows a small amount of blow-by gases to flow through. However, as revolution speed of the internal combustion engine increases, reduced intake-manifold vacuum causes the PCV valve 10 to open wider so as to allow more blow-by gases to flow through.

With the previously-discussed arrangement, owing to the pressure difference between the throttle-valve upstream side and the throttle-valve downstream side, fresh air is introduced through the fresh-air inlet 8 into the crankcase 4 as well as the valve operating chamber 6, so that crankcase 4 and valve operating chamber 6 are both ventilated. By this, blow-by gases (blow-by fumes) in crankcase 4 and valve operating chamber 6, together with fresh air flowing through the crankcase 4, can be introduced via the PCV valve 10 of blow-by gas discharge port 9 into the throttle-valve downstream side (e.g., the intake manifold).

To remove oil mist mixed with the blow-by gases, oil separator 1 is integrally formed with and arranged inside of the cylinder head cover 7 on the side of cylinder head cover 7 having the blow-by gas discharge port 9.

By the way, two sorts of arrows in FIG. 1 indicate blow-by gas flow and fresh-air flow, during low and middle engine-load operating conditions. However, during a high engine-load operating condition (near wide open throttle (WOT), part of blow-by gases can be exhausted through the fresh-air inlet 8 as well as blow-by gas discharge port 9 into the intake system. Therefore, an oil separator similar to oil separator 1 (a primary oil separator) may be disposed inside of cylinder head cover 7 on the side of cylinder head cover 7 having the fresh-air inlet 8. That is to say, oil separator 1 of the embodiment can be applied as a secondary oil separator disposed on the side of cylinder head cover 7 having the fresh-air inlet 8 as well as a primary oil separator disposed on the side of cylinder head cover 7 having the blow-by gas discharge port 9.

Figure 2:
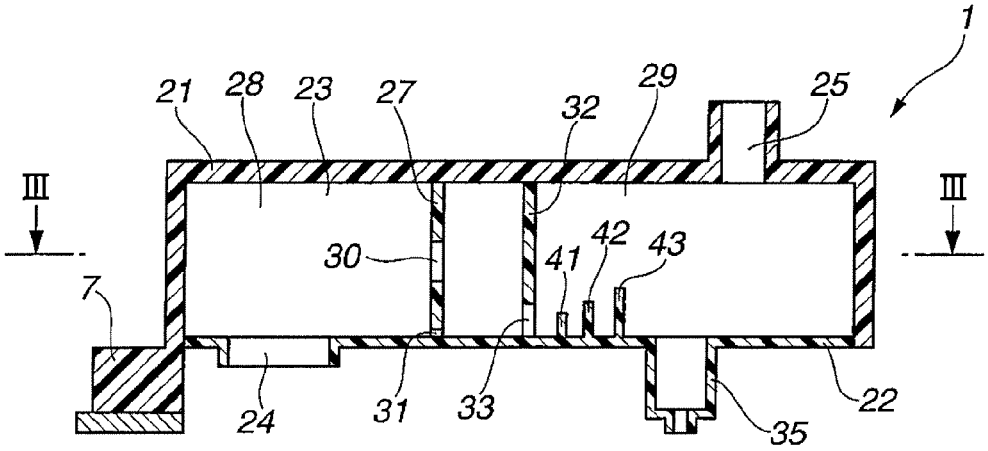
FIG. 2 is a vertical cross-sectional view showing the oil separator of the embodiment.
Figure 3:
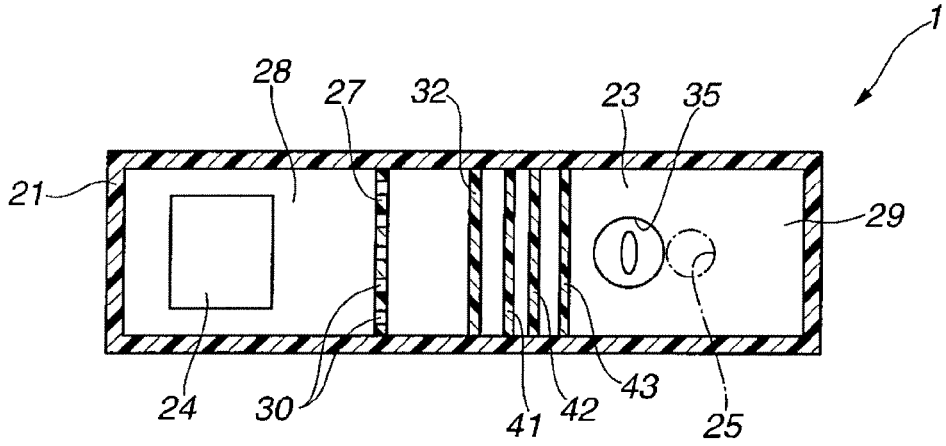
FIG. 3 is a horizontal cross-sectional view taken along the line III-III of FIG. 2.

FIG. 2 shows the vertical cross-section of oil separator 1 formed integral with the synthetic-resin cylinder head cover 7, whereas FIG. 3 shows the horizontal cross-section of oil separator 1. Oil separator 1 is comprised of (i) a housing portion 21 formed integral with the ceiling side of cylinder head cover 7 for defining an elongated internal fluid-flow-passage area and a lower opening, and (ii) a synthetic-resin separator cover 22 configured to be substantially conformable to the shape of the lower opening of housing portion 21 so as to cover the lower opening by integrally connecting the separator cover 22 to the cylinder head cover 7. In the shown embodiment, as seen from the cross sections of FIGS. 2-3, housing portion 21 is integrally formed with the cylinder head cover 7. It will be appreciated that the invention is not limited to such a particular embodiment (i.e., oil separator 1 including the housing portion 21 integrally formed with the cylinder head cover 7), but oil-separator housing portion 21 may be separated from the cylinder head cover 7. That is, as a modification, oil-separator housing portion 21 may be formed independently of the cylinder head cover 7.

As can be appreciated from the cross section of FIG. 1, oil separator 1 (comprised of housing portion 21 and separator cover 22) is configured as an elongated oil-separator case extending in a direction perpendicular to the engine-cylinder row, that is, in the lateral direction perpendicular to the longitudinal direction of the engine (the multi-cylinder in-line engine). As clearly shown in FIGS. 2-3, an elongated separator chamber 23 having a rectangular cross section is defined between the housing portion 21 and the separator cover 22. A blow-by gas inlet 24 is located on one side (at the lower left end, viewing FIG. 2) of separator chamber 23 in its longitudinal direction, while a blow-by gas outlet 25 is located on the opposite side (at the upper right end, viewing FIG. 2) of separator chamber 23 in its longitudinal direction. Hence, blow-by gases (blow-by fumes) basically flow through the interior space of separator chamber 23 parallel to the longitudinal direction of separator chamber 23.

As best seen from the cross section of FIG. 3, blow-by gas inlet 24 is a rectangular opening (a comparatively large rectangular window) formed in the separator cover 22. That is, in the shown embodiment, blow-by gas inlet 24 is configured to open through the bottom face of separator chamber 23, and thus separator chamber 23 is opened via the blow-by gas inlet 24 into the valve operating chamber 6. On the other hand, blow-by gas outlet 25 is located at the upside of housing portion 21. In other words, blow-by gas outlet 25 is configured to penetrate the ceiling wall of cylinder head cover 7. As previously described, when oil separator 1 is arranged inside of the cylinder head cover 7 on the side of cylinder head cover 7 having the blow-by gas discharge port 9, blow-by gas outlet 25 serves as the blow-by gas discharge port 9 and therefore PCV valve 10 is installed in the blow-by gas outlet 25. In the shown embodiment, blow-by gas outlet 25 is located at the ceiling wall of housing portion 21. In lieu thereof, blow-by gas outlet 25 may be located at the right-hand sidewall section of housing portion 21 in close proximity to the ceiling wall of housing portion 21 or at the corner of the intersecting two surfaces, namely the ceiling wall surface and the sidewall surface of housing portion 21.

A partition wall (a partition plate) 27 is disposed substantially at a longitudinal midpoint of separator chamber 23, in a manner so as to cross the longitudinal axis (the longitudinal direction) of separator chamber 23 at right angles. Thus, separator chamber 23 is partitioned into two chambers, namely (i) a separator inlet chamber 28 on the side of blow-by gas inlet 24 and (ii) a separator outlet chamber 29 on the side of blow-by gas outlet 25 by the partition wall 27. In the shown embodiment, partition wall 27 is integrally formed with the separator cover 22 and also configured to upwardly extend to such a height as to reach the ceiling wall surface of housing portion 21. In lieu thereof, partition wall 27 may be integrally formed with the housing portion 21, that is, the cylinder head cover 7, rather than the separator cover 22. Partition wall 27 has a plurality of small holes (slots or fine fluid passages) 30, each of which serves as an orifice for increasing a flow velocity of blow-by gas flowing therethrough. As seen from the cross sections of FIGS. 2-3, in the shown embodiment, small holes 30 are formed as vertically-elongated through holes substantially at an intermediate position of partition wall 27 in the vertical direction and arranged to be equidistant-spaced each other in the lateral direction of separator chamber 23. As clearly shown in FIG. 2, partition wall 27 has a cutout 31 formed substantially at a midpoint of the lower end of partition wall 27, for permitting oil droplets, which become changed from mist (fine oil droplets) in the separator inlet chamber 28 and growing to greater particle sizes, to flow toward the separator outlet chamber 29. In the shown embodiment (see FIGS. 2-3), cutout 31 is formed substantially at a midpoint of the lower end of partition wall 27. In lieu thereof, two cutouts 31, 31 may be formed on both sides of the lower end of partition wall 27 so as to permit oil droplets, which become changed from mist (fine oil droplets) in the separator inlet chamber 28 and further growing to greater particle sizes, to flow toward the separator outlet chamber 29.

A collision plate 32 is disposed in the separator outlet chamber 29 in a manner so as to be arranged adjacent to and parallel to the partition wall 27. In order to effectively separate oil mist from the high-velocity blow-by gas flow, collision plate 32 and partition wall 27 are horizontally opposed to each other so that collision plate 32 is appropriately spaced a predetermined distance apart from each of small holes 30 of partition wall 27. In the shown embodiment, in a similar manner to the previously-discussed partition wall 27, collision plate 32 is integrally formed with the separator cover 22 and also configured to upwardly extend to such a height as to reach the ceiling wall surface of housing portion 21. In lieu thereof, collision plate 32 may be integrally formed with the housing portion 21, that is, the cylinder head cover 7. For the purpose of enhancing an oil mist capture-and-separation performance, in other words, to increase the surface area of collision plate 32, facing each of small holes 30 of partition wall 27, the surface of collision plate 32 may be formed as a concavoconvex surface having a plurality of vertically-extending recessed grooves. A slit-shaped opening 33 is formed at the lower end of collision plate 32 to define a laterally-elongated narrow aperture (a laterally-elongated narrow fluid-flow passage) in cooperation with the bottom face of separator chamber 23. In the shown embodiment, collision plate 32 is integrally formed with the separator cover 22 in a manner so as to stand up from the bottom face of separator cover 22, and thus the opening 33 of collision plate 32 is partly formed as a central rectangular window substantially at a midpoint of the lower end of collision plate 32. In such a case, both sides of the central rectangular window (slit-shaped opening 33) of the lower end of collision plate 32 function as a support structure for collision plate 32. In contrast, assume that collision plate 32 is integrally formed with the housing portion 21 (in other words, the cylinder head cover 7). In such a case, it is possible to form the slit-shaped opening 33 over the entire width of collision plate 32. Oil droplets, adhered to the collision plate 32 and thus separated from the blow-by gases owing to collision of high-velocity blow-by gases passing through small holes (vertically-elongated laterally-equidistant-spaced through holes) 30 with the collision plate 32, flow down along the wall surface of collision plate 32, and pass through the slit-shaped opening 33 and then flow along the bottom face of separator chamber 23 toward the downstream side.

As seen from the cross section of FIGS. 2-3, a drain pipe 35 (an oil drain to valve operating chamber 6) is formed integral with the separator cover 22 and arranged in the bottom face of separator outlet chamber 29 for draining the captured oil to the valve operating chamber 6. Drain pipe 35 is a downwardly-extending cylindrical-hollow pipe directed toward the valve operating chamber 6. The lowermost end of drain pipe 35 is formed as a small-diameter oil drain port.

Figure 4:
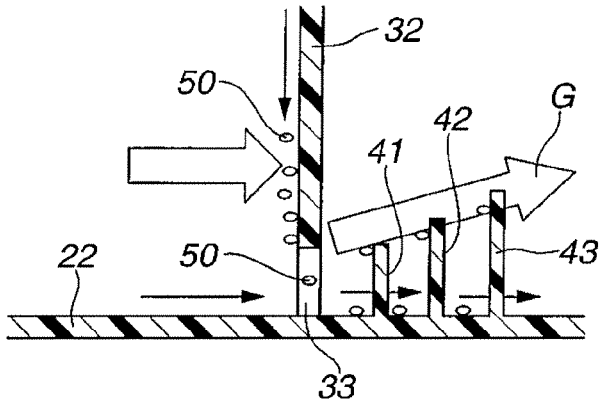
FIG. 4 is a partly-enlarged vertical cross-sectional view illustrating the essential part of the oil separator of the embodiment, namely, a slit-shaped opening and upstanding (vertically-protruding) walls.

As clearly shown in FIGS. 2-4, in the oil separator 1 of the embodiment, also provided are three upstanding (vertically-protruding) walls 41, 42, and 43 disposed between the collision plate 32 and the drain pipe 35. These upstanding walls 41-43 are constructed by three upright plates vertically protruding from the bottom face of separator chamber 23 and arranged parallel to the backface of collision plate 32. In the shown embodiment, upstanding walls 41-43 are integrally formed with the separator cover 22. Of these upstanding walls 41-43, the first upstanding wall 41 is arranged nearest to the slit-shaped opening 33. The height of the first upstanding wall 41 is dimensioned to be equal to or slightly less than the height of opening 33. The second upstanding wall 42 is located to be appropriately spaced a predetermined distance apart from the first upstanding wall 41 toward the downstream side. The third upstanding wall 43 is located to be appropriately spaced apart from the second upstanding wall 42 toward the downstream side by the same distance as the predetermined distance between the first upstanding wall 41 and the second upstanding wall 42. The height of the second upstanding wall 42 is dimensioned to be higher than that of the first upstanding wall 41, and also the height of the third upstanding wall 43 is dimensioned to be higher than that of the second upstanding wall 42. That is, the first upstanding wall 41, located nearest to the slit-shaped opening 33, has the lowest height in comparison with the others (42-43). The greater the distance of the upstanding wall, spaced apart from the opening 33 of collision plate 32, the higher the height of the upstanding wall that can be protruded upright from the bottom face of separator cover 22. As discussed later, this reconciles an advantageous oil-mist recapture effect and a reasonably-suppressed blow-by gas flow resistance. More concretely, in the shown embodiment, each of upstanding walls 41-43 has a height proportional to its distance from the collision plate 32. As seen from the partly-enlarged vertical cross section of FIG. 4, the uppermost ends of upstanding walls 41-43 are in alignment with each other substantially along an upward-slanting straight line to the right (viewing FIG. 4). Suppose that the heights of upstanding walls 41-43 are excessively high. In such a case, a fluid-flow resistance (i.e., a blow-by gas flow resistance) tends to be undesirably increased. In the oil separator 1 of the embodiment, the heights of upstanding walls 41-43 are properly designed or tuned to effectively suppress or prevent oil mist (fine oil droplets), once-separated from blow-by gases in the form of oil droplets having greater particle diameters owing to collision-contact with the collision plate 32, from rescattering along with blow-by gas flow passing through the opening 33. Returning to the cross section of FIG. 2, the heights of upstanding walls 41-43 are dimensioned to be remarkably low in comparison with the overall height of separator chamber 23, but dimensioned to be sufficient to recapture the once-separated oil mist (in the form of oil droplets having greater particle sizes) rescattering along with blow-by gas flow passing through the opening 33. As seen from the vertical cross section of FIG. 2, that is, when viewed in the lateral direction of separator chamber 23, it is unnecessary to further increase the heights of upstanding walls 41-43 shown in FIG. 2 to such heights as to disturb straight fluid-flow lines, directed from the opening 33 to the blow-by gas outlet 25. In other words, the heights of upstanding walls 41-43 are dimensioned to be less than or equal to the lowermost flow line of straight fluid-flow lines, directed from the opening 33 to the blow-by gas outlet 25. In the top view of FIG. 3, upstanding walls 41-43 are located so as to cross the flow direction of blow-by gases, directed from the opening 33 toward the blow-by gas outlet 25.

Figure 5:
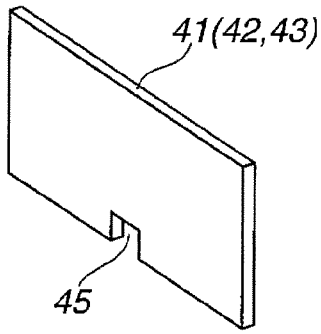
FIG. 5 is a perspective view of the upstanding wall having a central cutout formed substantially at a midpoint of the lower end of the upstanding wall.
Figure 6:
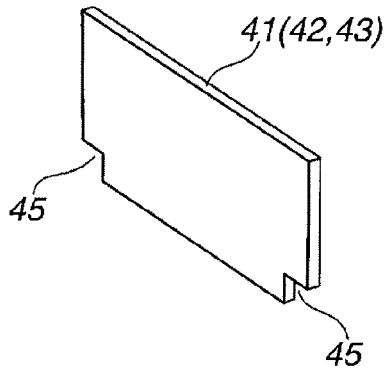
FIG. 6 is a perspective view of a modified upstanding wall having a double-side cutout formed on both sides of the lower end of the upstanding wall.
Figure 7:
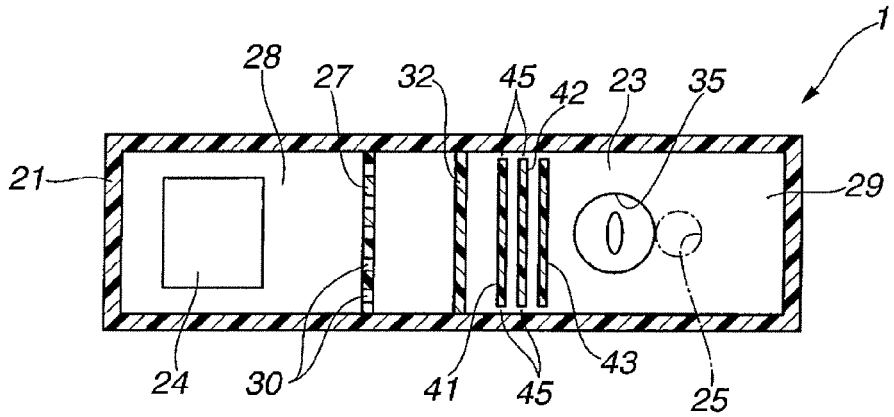
FIG. 7 is a horizontal cross-sectional view similar to FIG. 3 but showing the oil separator having the modified upstanding walls of FIG. 6, each wall having the double-side cutout.

Each of upstanding walls 41-43 is also formed with at least one cutout 45 to allow oil flow along the bottom face of separator chamber 23 toward the downstream side (see the central cutout 45 formed substantially at the midpoint of the lower end of each of upstanding walls 41-43 shown in FIG. 5 or see the two cutouts 45, 45 formed on both sides of the lower end of each of upstanding walls 41-43 shown in FIG. 6). In the shown embodiment, as shown in FIG. 5, each of upstanding walls 41-43 has the central cutout 45. Also, in the modification of FIG. 6, each of upstanding walls 41-43 has the two cutouts 45, 45 formed on both sides. In lieu thereof, regarding a plurality of upstanding walls, the upstanding wall with the central cutout 45 and the upstanding wall with the double-side cutout (45, 45) may be appropriately combined with each other. For instance, the three upstanding walls may be constructed such that one of three upstanding walls 41-43 has the double-side cutout (45, 45) and the others have the central cutout 45.

The double-side cutout (45, 45) of each of upstanding walls 41-43 shown in FIG. 6 is formed as a double-side small rectangular window, partly cut on both sides of the lower end of each of upstanding walls 41-43. In lieu thereof, the double-side cutout (45, 45) may be formed as a double-side vertically-elongated fluid-flow passage extending over the overall height of the upstanding wall. In this modification, actually, two side edges of each of upstanding walls 41-43 are slightly spaced apart from the separator-chamber sidewalls opposing each other.

In the oil separator 1 constructed as discussed above, the flow of blow-by gases flowing from blow-by gas inlet 24 through separator chamber 23 toward blow-by gas outlet 25, is throttled by small holes 30 (each serving as an orifice) of partition wall 27, thereby causing high-velocity blow-by gas flow. Hence, the high-velocity blow-by gas flow is brought into collision-contact with the collision plate 32. Owing to collision-contact of high-velocity blow-by gas flow with the surface of collision plate 32, oil mist (fine oil droplets) contained in the blow-by gases can be adhered to the surface of collision plate 32 and thus separated from the blow-by gases in the form of oil droplets having greater particle diameters. The captured oil mist (the oil droplets flowing down along the collision plate) further grow to greater particle diameters. As seen from oil droplets 50 schematically shown in FIG. 4, the oil droplets, growing to greater particle sizes, drop onto the bottom face of separator chamber 23 from the lower edge of collision plate 32 (in other words, the upper edge of opening 33), while crossing the opening 33, and then flow along the separator-chamber bottom face toward the downstream side. At the same time, the blow-by gases, from which oil mist has been removed or separated, also pass through the opening 33 at high speeds. Thus, part of oil-droplets 50, flowing down from the lower part of collision plate 32 to within the opening 33, tends to be undesirably mixed again with the high-velocity blow-by gas flow passing through the opening 33 so that some oil droplets, mixed again with the high-velocity blow-by gas flow, scatter again (rescatter) along with the high-velocity blow-by gas flow passing through the opening 33. However, according to the oil separator 1 of the embodiment, the rescattered oil mist (i.e., some oil droplets, mixed again with the high-velocity blow-by gas flow) can be recaptured by virtue of reasonable interference in the high-velocity blow-by gas flow, which has passed through the opening 33, by means of upstanding walls 41-43 having appropriately-tuned heights and located immediately downstream of and adjacent to the opening 33 of collision plate 32, in other words, by virtue of reasonable collision-contact of the high-velocity blow-by gas flow containing the rescattered oil mist with the upstanding walls 41-43. In this manner, the recaptured oil can be recovered into the valve operating chamber 6 via the oil drain port of drain pipe 35 formed in the bottom face of separator chamber 23. As indicated by the arrow "G" in the partly-enlarged vertical cross-sectional view of FIG. 4, the high-velocity flow of blow-by gases, immediately after having passed through the opening 33, tends to direct somewhat upwards. In the shown embodiment, the uppermost ends of the first upstanding wall 41, the second upstanding wall 42, and the third upstanding wall 43 are positioned to gradually rise in that order. Hence, it is possible to ensure a high oil-mist recapture performance without excessively increasing the resistance to high-velocity blow-by gas flow. In particular, the height of the first upstanding wall 41, located nearest to the opening 33, is dimensioned to be comparatively low, thereby avoiding an excessive increase in the fluid-flow resistance (i.e., the blow-by gas flow resistance). Each of upstanding walls 41-43 has at least one cutout, cut along the bottom face of separator chamber 23 (see the central cutout 45 in FIG. 5 or see the double-side cutout (45, 45) in FIG. 6), and thus (i) oil, recaptured by means of each of upstanding walls 41-43, and (ii) oil, flowing along the bottom face of separator chamber 23 without rescattering along with high-velocity blow-by gas flow at the opening 33 of collision plate 32, can further flow through the cutouts 45 of upstanding walls 41-43 to the downstream side. Finally, these oils are dropped and recovered into the valve operating chamber 6 via the oil drain port of drain pipe 35.

Figure 8:
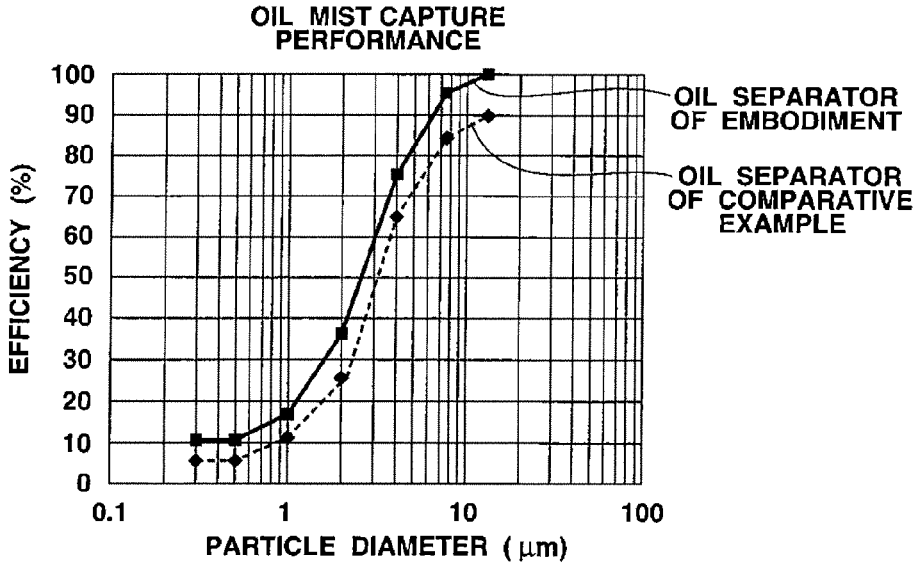
FIG. 8 is a characteristic diagram illustrating the difference between an oil mist capture efficiency obtained by the upstanding-wall equipped oil separator of the embodiment and an oil mist capture efficiency obtained by a non-upstanding-wall-equipped oil separator of a comparative example.

Referring now to FIG. 8, there is shown the oil mist capture performance characteristic diagram explaining the difference between (i) the oil mist capture efficiency obtained by the upstanding-wall equipped oil separator 1 of the embodiment having three upstanding walls 41-43 shown in FIGS. 2-4 and (ii) the oil mist capture efficiency obtained by a non-upstanding-wall-equipped oil separator of the comparative example. As seen from comparison between the two different oil mist capture performance characteristic curves of FIG. 8, the oil separator 1 of the embodiment has an approximately 10%-improved oil mist capture performance (indicated by the solid line in FIG. 8) over the entire range of particle diameter (particle size), when compared to the comparative example (indicated by the broken line in FIG. 8). As discussed previously, according to the oil separator 1 of the embodiment, it is possible to more efficiently recapture the once-separated oil mist, which tends to rescatter along with blow-by gas flow passing through the opening of the collision plate, by means of upstanding walls 41-43, provided immediately downstream of (immediately in rear of) the opening of the collision plate, thereby more certainly reducing the amount of oil mist, which may be carried together with the outgoing blow-by gas flow from the blow-by gas outlet to the exterior (i.e., the intake system). Therefore, it is possible to more remarkably enhance or improve the total oil mist capture performance of the oil separator.

In the shown embodiment, oil separator 1 is configured to have three upstanding walls 41-43, but the number of upstanding walls is not limited to "3". For instance, oil separator 1 may have three or more upstanding walls between the collision plate 32 and the drain pipe 35 so as to recapture the once-separated oil mist, which tends to rescatter along with blow-by gas flow passing through the opening of the collision plate. Alternatively, oil separator 1 may have two or less upstanding walls between the collision plate 32 and the drain pipe 35 so as to recapture the once-separated oil mist, which tends to rescatter along with blow-by gas flow passing through the opening of the collision plate. Also, in the case of oil separator 1 of the embodiment, having a plurality of upstanding walls (concretely, three upstanding walls 41-43), each of the upstanding walls is configured to have a height proportional to its distance from the collision plate 32, but the height of each upstanding wall does not necessarily have to be directly proportional to its distance from the collision plate 32. However, to more certainly balance two contradictory requirements, that is, a reasonably-suppressed fluid-flow resistance (a reasonably-suppressed blow-by gas flow resistance) and an improved oil mist capture efficiency, it is preferable that the uppermost ends of the upstanding walls are positioned to gradually rise such that each of the upstanding walls has a height proportional to its distance from the collision plate 32. The test results were experimentally assured by the inventors of the present invention. Furthermore, in the shown embodiment, three component parts, namely, (i) partition wall 27, (ii) collision plate 32, and (iii) upstanding walls 41-43 are integrally formed with the synthetic-resin separator cover 22 as a part of separator cover 22. In lieu thereof, at least one of the three component parts may be integrally formed with the cylinder head cover 7 (in other words, the oil-separator housing portion 21). Alternatively, partition wall 27, collision plate 32, and upstanding walls 41-43 may be integrally formed as a single vertically-extending parallel-wall sub-assembly, and then the parallel-wall sub-assembly may be integrally connected to either the cylinder head cover 7 or the separator cover 22.

Moreover, in the shown embodiment, as can be seen from the cross sections of FIGS. 2-3, the housing portion 21 of oil separator 1 is formed as a rectangular shape. Practically, the shape of housing portion 21 may be somewhat modified and configured to be substantially conformable to the contour of cylinder head cover 7.

The entire contents of Japanese Patent Application No. 2011-128565 (filed Jun. 8, 2011) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An oil separator provided in a cylinder head cover of an internal combustion engine for separating oil mist from blow-by gases to be discharged out of the engine through the cylinder head cover, comprising:

a separator chamber having a blow-by gas inlet formed at one end and a blow-by gas outlet formed at another end;

a partition wall configured to partition the separator chamber into a separator inlet chamber communicating with the blow-by gas inlet and a separator outlet chamber communicating with the blow-by gas outlet, the partition wall having a plurality of through holes;

a collision plate disposed in the separator outlet chamber and arranged adjacent to the partition wall so as to be opposed to each of the plurality of through holes;

an opening defined between a lower end of the collision plate and a bottom face of the separator chamber;

an oil drain arranged in the bottom face of the separator chamber for draining oil, separated from the blow-by gases, from the bottom face of the separator chamber into a valve operating chamber of the engine;

at least one upstanding wall disposed downstream of the collision plate in a manner so as to be adjacent to the opening, and vertically protruding from the bottom face of the separator chamber and arranged parallel to the collision plate; and at least one cutout defined between a lower end of an upstanding wall and the bottom face of the separator chamber for allowing oil flow along the bottom face of the separator chamber, wherein said at least one upstanding wall comprises a plurality of upstanding walls spaced apart from each other and arranged parallel to each other, and wherein heights of the plurality of upstanding walls differ from each other such that a height of a downstream one of two adjacent upstanding walls of the plurality of upstanding walls is dimensioned to be higher than an upstream one of the two adjacent upstanding walls.

2. The oil separator as claimed in claim 1, wherein:

each of the plurality of upstanding walls is configured to have a height proportional to its distance from the collision plate.

3. The oil separator as claimed in claim 2, wherein:

the heights of the plurality of upstanding walls are dimensioned to be less than or equal to a lowermost flow line of straight fluid-flow lines, directed from the opening to the blow-by gas outlet.

4. The oil separator as claimed in claim 1, wherein:

the opening is configured by either a rectangular window partly formed at the lower end of the collision plate or a laterally-elongated slit formed over an entire width of the collision plate.

5. The oil separator as claimed in claim 1, wherein:

the cutout is configured by either a central cutout formed substantially at a midpoint of the lower end of the upstanding wall or a double-side cutout formed on both sides of the lower end of the upstanding wall.

6. An oil separator provided in a cylinder head cover of an internal combustion engine for separating oil mist from blow-by gases to be discharged out of the engine through the cylinder head cover, comprising:

a separator chamber having a blow-by gas inlet formed at one end and a blow-by gas outlet formed at another end;

a partition wall configured to partition the separator chamber into a separator inlet chamber communicating with the blow-by gas inlet and a separator outlet chamber communicating with the blow-by gas outlet, the partition wall having a plurality of through holes;

a collision plate disposed in the separator outlet chamber and arranged adjacent to the partition wall so as to be opposed to each of the plurality of through holes;

an opening defined between a lower end of the collision plate and a bottom face of the separator chamber;

an oil drain arranged in the bottom face of the separator chamber for draining oil, separated from the blow-by gases, from the bottom face of the separator chamber into a valve operating chamber of the engine;

at least one upstanding wall disposed downstream of the collision plate in a manner so as to be adjacent to the opening, and vertically protruding from the bottom face of the separator chamber and arranged parallel to the collision plate; and at least one cutout defined between a lower end of an upstanding wall and the bottom face of the separator chamber for allowing oil flow along the bottom face of the separator chamber, wherein the opening is configured by either a rectangular window partly formed at the lower end of the collision plate or a laterally-elongated slit formed over an entire width of the collision plate.

* * * * *